US007828144B2

(12) United States Patent
Bentley et al.

(10) Patent No.: US 7,828,144 B2
(45) Date of Patent: Nov. 9, 2010

(54) CLOTHES HANGER STORAGE DEVICE

(75) Inventors: Renee M. Bentley, P.O. Box 1342, Meridian, ID (US) 83680; Taylor Jenkins, Nampa, ID (US)

(73) Assignee: Renee M. Bentley, Meridian, ID (US)

( * ) Notice: Subject to any disclaimer, the term of this patent is extended or adjusted under 35 U.S.C. 154(b) by 144 days.

(21) Appl. No.: 12/013,373

(22) Filed: Jan. 11, 2008

(65) Prior Publication Data

US 2008/0110777 A1 May 15, 2008

Related U.S. Application Data

(62) Division of application No. 11/001,536, filed on Nov. 30, 2004, now abandoned.

(51) Int. Cl.
*B65D 85/00* (2006.01)
*A47G 25/14* (2006.01)

(52) U.S. Cl. ..... 206/300; 206/284

(58) Field of Classification Search ..... 206/300, 206/279, 284, 288–291, 546; 220/326, 784, 220/788, 315, 324, 785, 786, 787; 211/49.1; 215/273; 292/70, 76, 17, 137, 150, 80
See application file for complete search history.

(56) References Cited

U.S. PATENT DOCUMENTS

| | | | | |
|---|---|---|---|---|
| 13,465 | A | 8/1855 | Lawton | |
| 623,594 | A | 4/1899 | Burt | |
| 653,699 | A | 7/1900 | Robinson | |
| 683,356 | A | 9/1901 | Todd | |
| 947,847 | A | 2/1910 | Recht | |
| 1,015,605 | A | 1/1912 | Wilt et al. | |
| 1,382,092 | A | 6/1921 | Kilmer | |
| 1,591,087 | A | 7/1926 | Holliday | |
| 1,601,180 | A | 9/1926 | Lindgren | |
| 1,740,828 | A | 12/1929 | Morrison | |
| 1,999,879 | A | 4/1935 | Lee | 206/46 |
| 2,082,007 | A | 6/1937 | Joseph | 206/7 |
| 2,175,324 | A | 10/1939 | Stamp | 249/92 |
| 2,370,417 | A | 2/1945 | Preston | 206/65 |
| 2,530,609 | A | 11/1950 | Friedman | 211/49 |

(Continued)

*Primary Examiner*—Mickey Yu
*Assistant Examiner*—Steven A. Reynolds
(74) *Attorney, Agent, or Firm*—Pedersen and Company, PLLC; Ken J. Pedersen; Barbara S. Pedersen

(57) ABSTRACT

A clothes hanger storage device includes a container and a plurality of pillars inside the container for retaining a multitude of variously-sized and -shaped hangers. The plurality of pillars may be arranged as two sets of pillars, or two elongated pillar units, wherein large triangular hangers extend around both sets of pillars or around the two elongated pillar units, and small triangular hangers extend around only one set of pillars or one elongated pillar unit. Non-triangular hangers, such as hangers only comprising two shoulders, may be stored in the container by being trapped between the container wall and the pillars, but not extending around the pillars. The clothes hanger storage device may be adapted to be hung from a door, stored underneath a counter or in a closet, or attached to the door of a cabinet. In an optional embodiment, the container may be fitted with a releasable lid that fits over the top of the container. The preferred lid may be moved to a dispensing position, which leaves room between the container and the lid through which one or more hangers may be removed.

13 Claims, 11 Drawing Sheets

U.S. PATENT DOCUMENTS

| | | | | | |
|---|---|---|---|---|---|
| 2,609,919 | A | * | 9/1952 | Lee | 206/300 |
| 3,115,968 | A | | 12/1963 | Peterson | 206/56 |
| 3,145,835 | A | * | 8/1964 | Byassee | 206/300 |
| D222,085 | S | | 9/1971 | Boley | D33/17 |
| D237,442 | S | | 11/1975 | Kiggens et al. | D6/181 |
| 3,987,898 | A | * | 10/1976 | Crane | 206/300 |
| 4,016,981 | A | | 4/1977 | Hildt | 211/49 R |
| D246,982 | S | | 1/1978 | Hamilton | D19/92 |
| 4,085,875 | A | | 4/1978 | Campbell et al. | 224/45 K |
| 4,424,905 | A | | 1/1984 | Keen | 211/49 R |
| 4,460,105 | A | * | 7/1984 | Cox | 220/830 |
| 4,611,718 | A | | 9/1986 | Cohn et al. | 211/49.1 |
| 4,711,383 | A | * | 12/1987 | Jenkins | 224/610 |
| 4,722,438 | A | | 2/1988 | Hicks | 206/300 |
| 4,957,206 | A | | 9/1990 | Banko et al. | 211/40 |
| 4,958,841 | A | | 9/1990 | Keen | 280/47.35 |
| D319,977 | S | | 9/1991 | Curry | D9/425 |
| D323,296 | S | | 1/1992 | Schoenthaler | D9/456 |
| 5,100,015 | A | * | 3/1992 | Vanderstuyf | 220/326 |
| 5,176,252 | A | | 1/1993 | Davis | 206/300 |
| D335,402 | S | | 5/1993 | Eckner | D6/462 |
| D339,691 | S | * | 9/1993 | Cunningham et al. | D3/293 |
| 5,265,558 | A | | 11/1993 | Schonrock | 119/28.5 |
| D359,013 | S | | 6/1995 | Carlson | D11/156 |
| 5,531,345 | A | * | 7/1996 | Nakamura et al. | 220/3.8 |
| 5,577,779 | A | * | 11/1996 | Dangel | 292/80 |
| D382,402 | S | | 8/1997 | Pawuk et al. | D3/304 |
| D392,818 | S | | 3/1998 | Shawhan | D6/467 |
| D395,756 | S | | 7/1998 | Tanji | D3/312 |
| 5,833,184 | A | | 11/1998 | Scola | 248/176.1 |
| D403,862 | S | | 1/1999 | Jones | D3/304 |
| 5,924,578 | A | | 7/1999 | McKenzie | 211/49.1 |
| D417,802 | S | | 12/1999 | Spurgeon et al. | D6/467 |
| D421,686 | S | | 3/2000 | Wacks | D6/466 |
| D422,412 | S | | 4/2000 | Greene | D3/314 |
| 6,109,457 | A | | 8/2000 | Dahnke | 211/49.1 |
| D436,728 | S | | 1/2001 | Harding | D3/304 |
| 6,230,904 | B1 | | 5/2001 | Licari | 211/49.1 |
| D465,352 | S | | 11/2002 | Kim | D6/462 |
| D482,374 | S | | 11/2003 | Fan | D15/90 |
| D483,945 | S | | 12/2003 | Tanji | D3/302 |
| D513,871 | S | | 1/2006 | Rosine et al. | D3/273 |
| D519,735 | S | | 5/2006 | Bentley et al. | D3/304 |
| D556,450 | S | | 12/2007 | Bentley et al. | D3/276 |

* cited by examiner

CLOTHES HANGER STORAGE DEVICE

This application claims priority, and is a divisional application, of U.S. Non-Provisional Application Ser. No 11/001,536, filed Nov. 30, 2004, the entire disclosure of which is incorporated herein by this reference.

BACKGROUND OF THE INVENTION

1. Field of the Invention

This invention relates to clothing hangers, and more specifically, to a container for stacking, storing, carrying, or dispensing a plurality of clothes hangers. The invention further relates to a container for storing clothes hangers comprising triangularly arranged pillars upending from the base of the container, so that a variety of differently-sized or -shaped hangers may be stacked over the pillars.

2. Related Art

In the dry cleaning business, retail businesses, and in home use, it is important to have a storage device for excess hangers. Do to the unusual shapes and sizes of clothing hangers, many become interlocked and tangled when stored loosely in a box. Often the box in which hangers are stored can be aesthetically unpleasing, and may take up valuable under-counter or other storage space. In an effort to provide an effective means for storing clothing hangers, many clothing hanger storage devices have been patented.

Issued patents relating to clothes hanger storing and carrying devices are reviewed hereinafter.

Peterson (U.S. Pat. No. 3,115,968) discloses a collapsible carton member for the storage of clothes hangers.

Hildt (U.S. Pat. No. 4,016,981) discloses a rack for storing clothes hangers having a single neck portion and two shoulder portions wherein the rack comprises a base and a plurality of elongated posts extending upwardly and perpendicular to the upper surface of the base.

Keen (U.S. Pat. No. 4,424,905) discloses a device for organizing, storing and dispensing garment hangers comprising a vertically disposed glide rod for engaging the hanger hook and two vertically disposed guide rods positioned on opposite sides of said glide rod and spaced forward thereof for engaging the respective outer shoulder portions of the garment hanger. The bottom ends of the guide rods and glide rod are mounted to a base.

Scola (U.S. Pat. No. 5,833,184) discloses a clothes hanger carrying device for neatly stacking and storing a plurality of conventional wire type clothes hangers. The carrying device includes a bottom base flange having a greater perimeter than the triangular body of the clothes hanger to provide a support for a plurality of the hangers, and a stacking body extending upwardly from the base flange.

Dahnke (U.S. Pat. No. 6,109,457) discloses a hanger guide attached to a base wherein the clothes hangers are received on the hanger guide.

Licari (U.S. Pat. No. 6,230,904) discloses a hanger package and display assembly comprising a top and bottom platform, and at least two spaced-apart rods vertically disposed between the platforms.

Design applications relating to clothes hanger storage devices are as follows: Kiggens et al. (U.S. Pat. No. D237,442); Pawuk et al. (U.S. Pat. No. D382,402); Shawhan (U.S. Pat. No. 392,818); Jones (U.S. Pat. No. 403,862); Spurgeon et al. (U.S. Pat. No. D417,802); Wacks (U.S. Pat. No. D421,686); and, Kim (U.S. Pat. No. D465,352).

SUMMARY OF THE INVENTION

The present invention is a clothes hanger storage device, and more specifically, a clothes hanger storage device comprising a container and a plurality of pillars inside said container for retaining a multitude of variously-sized and -shaped hangers. The plurality of pillars may be arranged as two sets of pillars, or two elongated pillar units, wherein large triangular hangers extend around both sets of pillars or around the two elongated pillar units, and small triangular hangers only extend around one set of pillars or one elongated pillar unit. Non-triangular hangers, such as hangers only comprising two shoulders, may be stored in the container by being trapped between the container wall and the pillars, but not extending around the pillars.

The preferred clothes hanger storage device may be adapted to be hung from a door, stored underneath a counter or in a closet, or attached to the door of a cabinet. In an optional embodiment, the container may be fitted with a releasable lid that fits over the top of the container. The preferred lid may be moved to a dispensing position, which leaves room between the container and the lid through which one or more hangers may be removed.

DESCRIPTION OF THE PREFERRED EMBODIMENTS

Figure 1A:
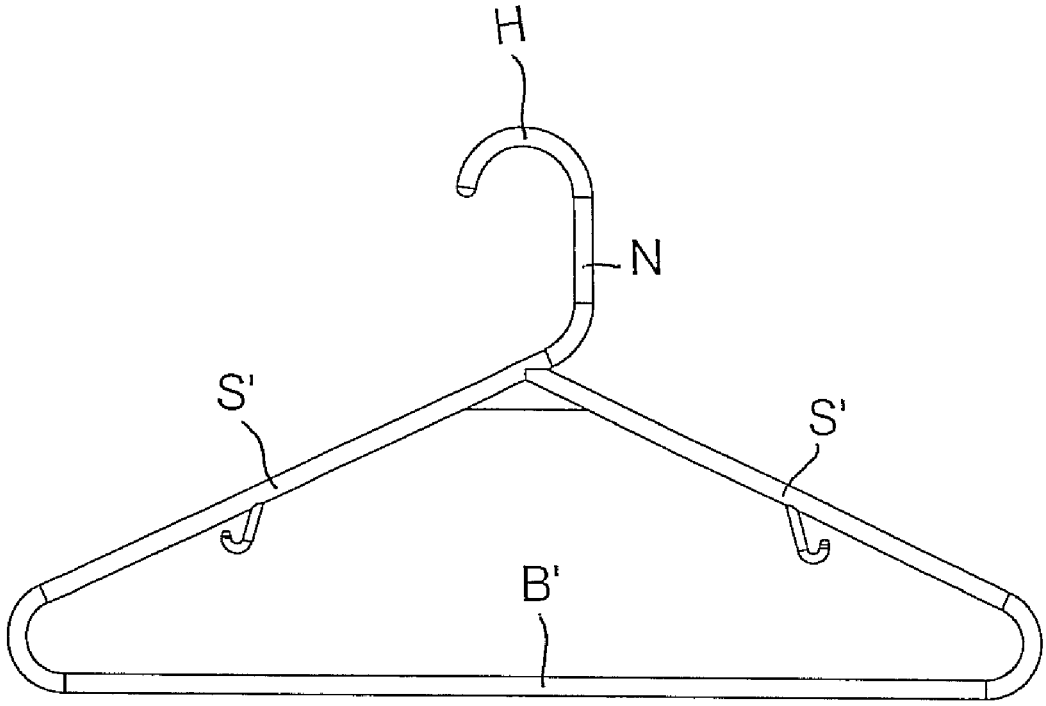
FIG. 1A is a front view of an example of a large triangular hanger.
Figure 1B:
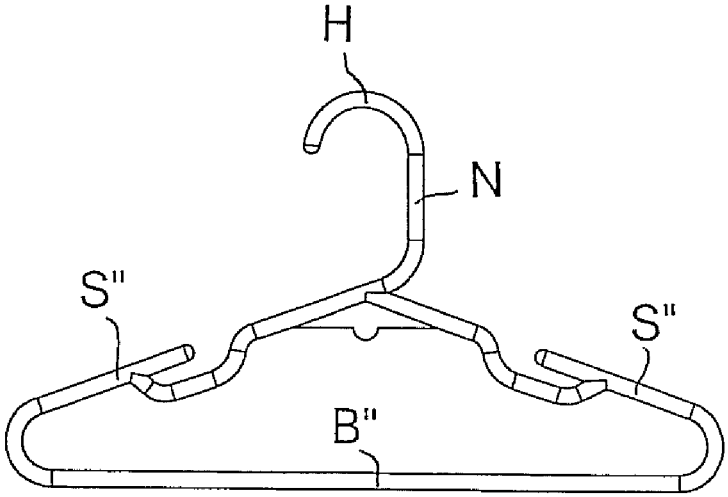
FIG. 1B is a front view of an example of a small triangular hanger.

Referring to the figures, there are shown some, but not the only embodiments of the invented clothes hanger storage device. In the preferred embodiment, the clothes hanger storage device 100 is used to stack, store, and carry a plurality of differently-shaped and -sized hangers. The clothes hangers comprise a hook H, a neck N, two shoulder sections S', S", and some hangers may comprise a base B', B" connecting the shoulder sections to form a triangular hanger (see FIGS. 1A and 1B).

Figure 2:
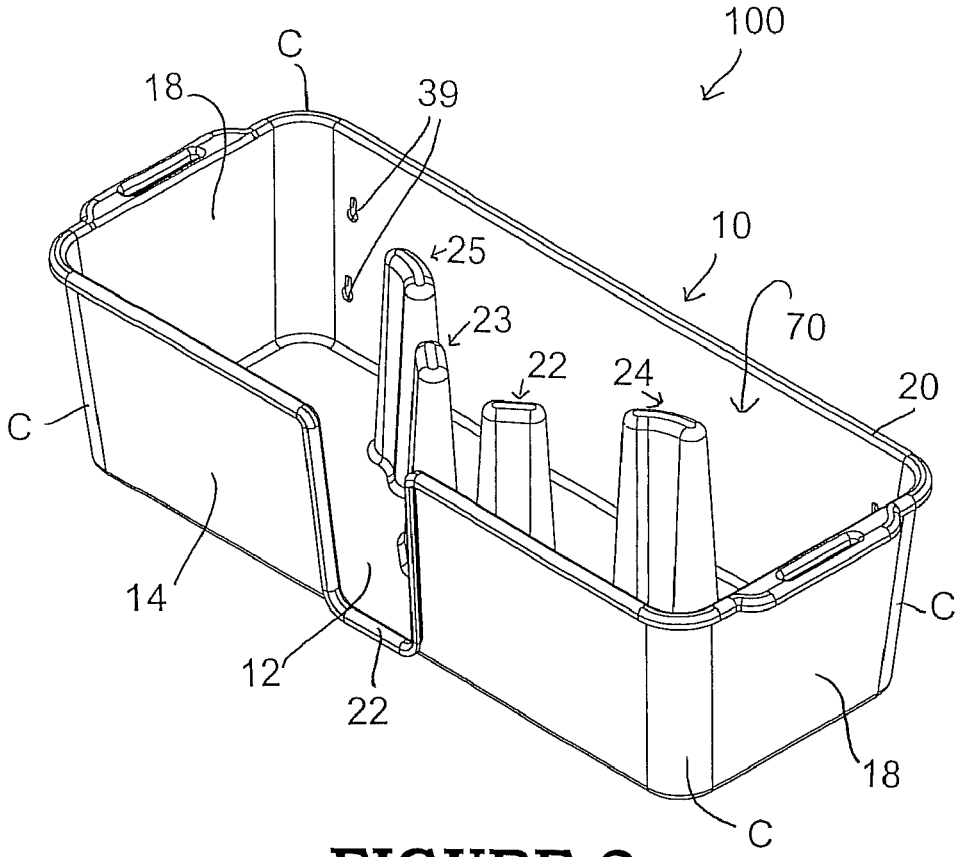
FIG. 2 is a perspective view of one embodiment of the invented clothes hanger storage device.
Figure 7:
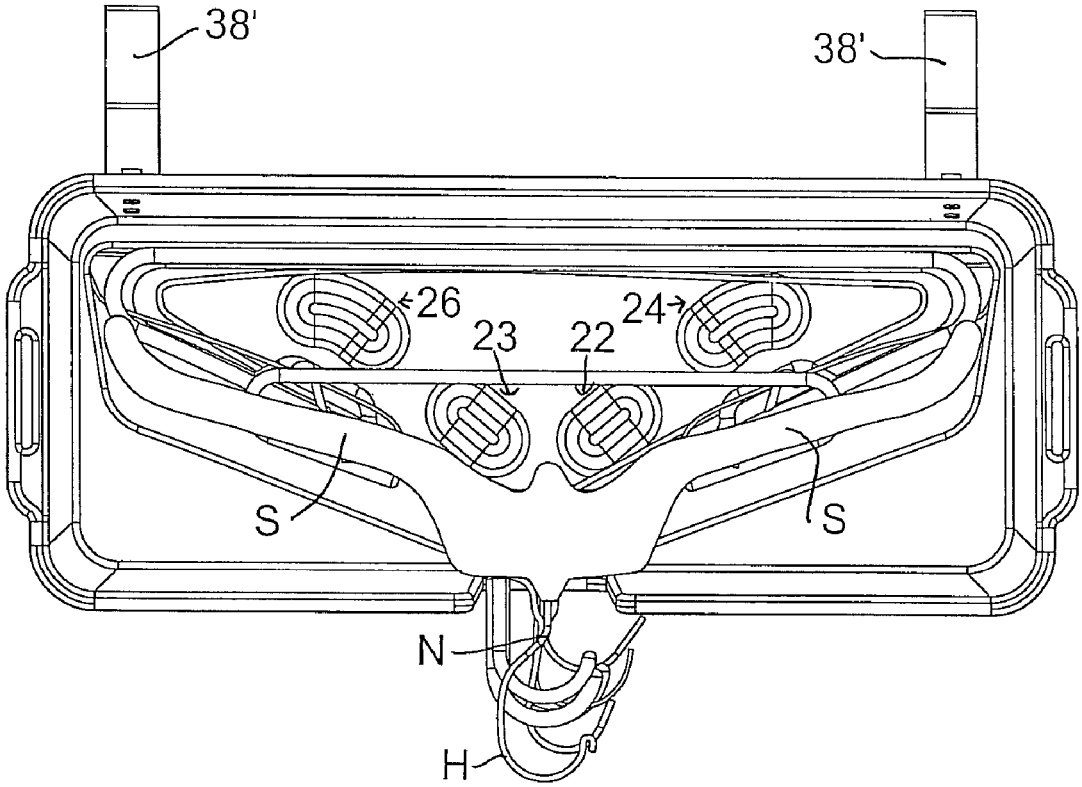
FIG. 7 is a top view of the embodiment shown in FIG. 4.

In the preferred embodiment, the clothes hanger storage device 100 is a generally rectangular container 10 comprising a plurality of side walls—a base 12, a front wall 14, a rear wall 16, and two end walls 18. The base 12 and the side walls define an interior space 70, as shown in FIG. 2. Preferably, the two end walls 18 are of equal length and the front 14 and rear 16 walls are of equal length. The front wall 14 comprises an elongated slot 22 that extends from the base 12 of the container to the top edge 20 of the front wall 14 for receiving the clothes hanger hooks H. The container 10 may comprise additional neck structure that extends from the elongated slot 22 and encloses the necks N and hooks H of the hangers. The container 10 is preferably of a height that will carry a reasonable number of hangers, for example 6"-10", so that the container is not too heavy to carry (see FIGS. 4 and 7). Larger containers may also be desired for clothing stores, dry cleaners, or laundry mats, for example. In the preferred embodiment, the container 10 is rectangular in shape; however, the inventor envisions that other shapes, such as a triangle, might be used so long as the entire hanger fits within the container. Additionally, handles with apertures 21 may be provided in the top edge 20 of the two end walls 18 for grasping the container 10 or for securing a lid 30 to the container 10.

Figure 3:
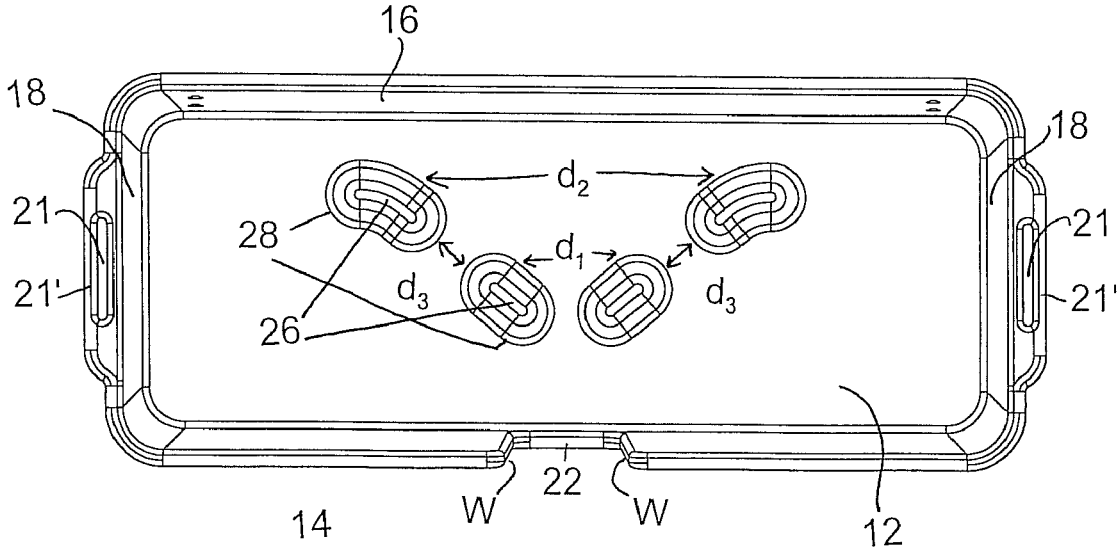
FIG. 3 is a top view of the embodiment shown in FIG. 2.

The preferred embodiment further comprises a plurality of pillars extending upward and generally perpendicular to the base 12 of the container 10. As shown in FIGS. 2 and 3, the plurality of pillars are preferably arranged as two sets of pillars in a triangular fashion—two pillars 22, 23 are positioned toward the front wall 14 of the container 10 and two pillars 24, 25 are positioned toward the rear wall 16 of the container 10. The rear pillars 24, 25 are in a plane parallel to the front pillars 22, 23, but spaced out a distance, so that the respective rear pillars 24, 25 are closer to the end walls 18 than are the front pillars 22, 23.

In the preferred embodiment, the pillars are integral with the base 12 of the container 10 meaning they are formed as an extension of the base, preferably by molding. The pillars are preferably not solid, so that there is a detent corresponding to each pillar in the bottom of the base of the container, so that the containers may be stacked one on top of the other with the pillars from one container sliding into the detents created by the hollow pillars of the other container. To accommodate the stacking of the containers, the pillar sides are sloped, as shown to best advantage in FIGS. 2 and 3, so that the tops 26 of the pillars are preferably smaller in dimension than the bottoms 28 of the pillars. The front pillars 22, 23 are generally cylindrical in shape, and the rear pillars 24, 25 are generally kidney-shaped; however, other shapes may be used, such as, conical, rectaganol, or other aesthetically pleasing or easy-to-mold shapes.

Figure 5:
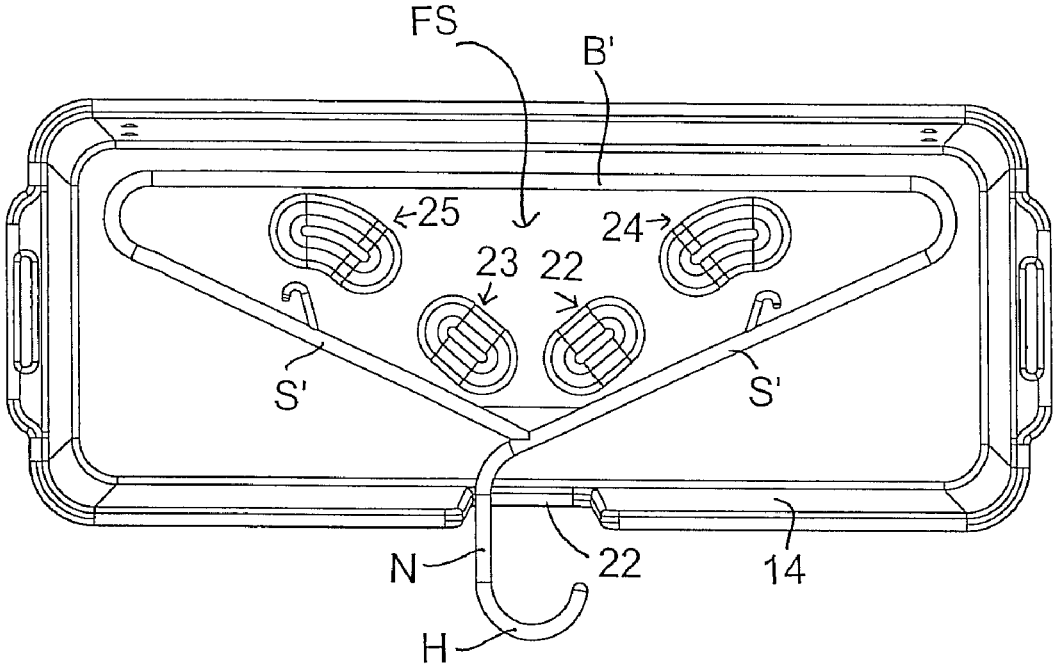
FIG. 5 is a top view of the embodiment shown in FIG. 3, wherein a large triangular hanger is shown positioned inside the container.
Figure 6:
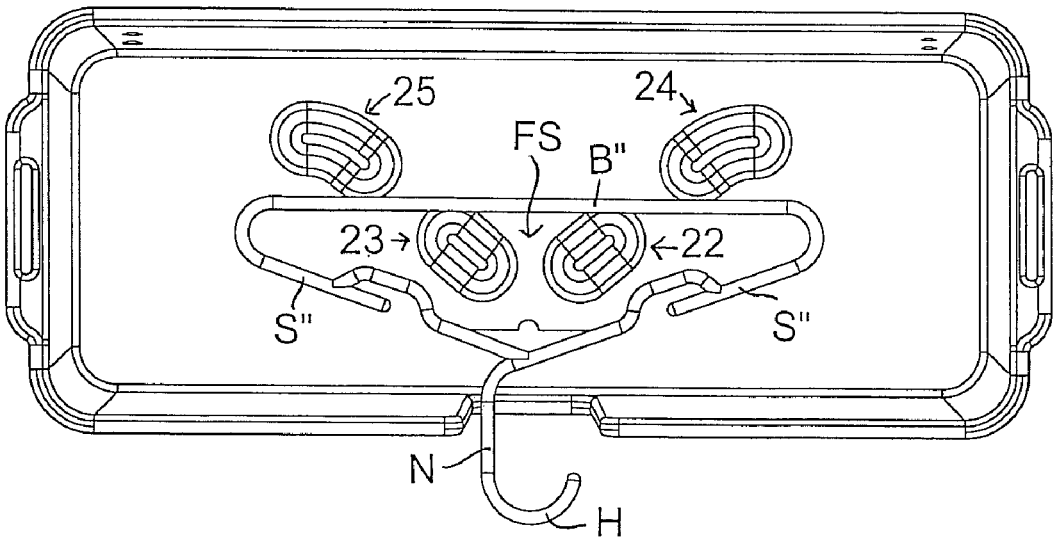
FIG. 6 is a top view of the embodiment shown in FIG. 3, wherein a small triangular hanger is shown positioned inside the container.

The sets of pillars are spaced-apart in a triangular arrangement, so that they can accommodate different shapes and sizes of hangers. The spacing between the two sets of pillars is sufficient, so that when a large triangular hanger (shown in FIG. 1A), having a base length between 12" and 14", and a height (from the base B' to the top of the hook H) between 9" and 10", is placed in the container, the two sets of pillars 22, 23 and 24, 25 are completely contained within the framed-space FS of the hanger, and the neck N and the hook H of the hanger extend out through the elongated slot 22 in the front wall 14 of the container 10 (see FIG. 5). Additionally, when a small triangular hanger (shown in FIG. 1B), having a base length between 9" and 12" and a height between 7" and 9", is placed in the container, only the front pillars 22, 23 are completely contained within the framed-space FS of the hanger, and the base B" of the smaller hanger is trapped in the space between the front pillars 22, 23, and the rear pillars 24, 25 (see FIG. 6). Further, the spacing between the front pillars 22, 23 and the front wall 14 of the container 10 is sufficient to accommodate a hanger comprising only a hook H, a neck N, and two shoulders, without a base connecting the two shoulders, so that the front pillars 22, 23 engage the underside of the neck portion and the rear pillars 24, 25 engage the underside of the two shoulders S. Thus, the hanger is trapped between the front wall 14 of the container 10 and the two sets of pillars 22, 23 and 24, 25; however, none of the hanger extends around the pillars (see FIG. 7).

In the preferred embodiment, the relationship between the container 10, the elongated slot 22, and the pillars 22, 23 and 24, 25 is such that they are oriented to accommodate a wide variety of hangers. The front 14 and rear 16 walls of the container 10 are preferably between 12"-14" in length from corner C to corner C, and the end walls 18 are preferably between 6"-10" long from corner C to corner C, but in the preferred embodiment, they are 7" long (see FIG. 2). The elongated slot 22, in the front wall 14, is between 1"-2" in width between its generally vertical walls W (see FIG. 3). The elongated slot 22 must be wide enough to fit differently-sized and -shaped hanger necks, but not too wide that the hanger necks move around significantly. The space between the front most extremities of the front pillars 22, 23 and the front wall 14 is preferably between 2.5"-4". The space between the rear most extremities of the rear pillars 24, 25 and the rear wall 16 is between 0.5"-4". Preferably, the relationship between the pillars and the respective walls is close enough in order to tightly retain the hangers around the pillars, or between the walls of the container and the pillars. As shown in FIG. 3, the two front pillars 22, 23 are spaced apart a distance $d_3$ between 2"-3", and the two back pillars 24, 25 are spaced apart a distance $d_2$ between 8"-10". The distance $d_3$ between one front pillar and one rear pillar is preferably between 0.5"-1"; however, this distance needs to be only as wide as the thickest small triangular hanger base.

Figure 12:
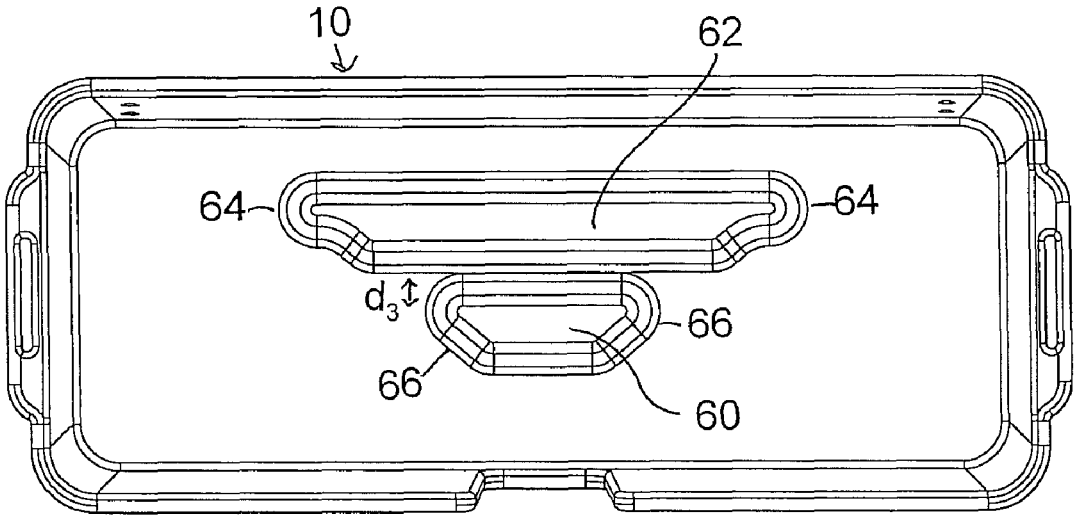
FIG. 12 is a top view of an alternative embodiment of the invented clothes hanger storage device, wherein the front pillars are shown as one elongated unit, and the rear pillars are shown as one elongated unit.

In an alternative embodiment, the plurality of pillars may be a set of two elongated pillars/units, one elongated pillar 60 being positioned toward the front wall 14 of the container 10 and the second elongated pillar 62 being positioned toward the rear wall 16 of the container 10 (see FIG. 12). Preferably, the two elongated pillars 60, 62 are parallel to each other, and the rear pillar 62 is longer in length than the front pillar 60. The two elongated pillars 60, 62 still resemble a triangular shape, so that they can accommodate a variety of hangers. The distance $d_3$ between the front pillar 60 and the back pillar 62 is preferably between 0.5"-1". In the alternative embodiment, the elongated pillars 60, 62 comprise ends 64, 66 that are slanted relative to the elongated pillar lengths, contributing to the triangular shape of the outer perimeter of the pillar grouping.

Figure 14:
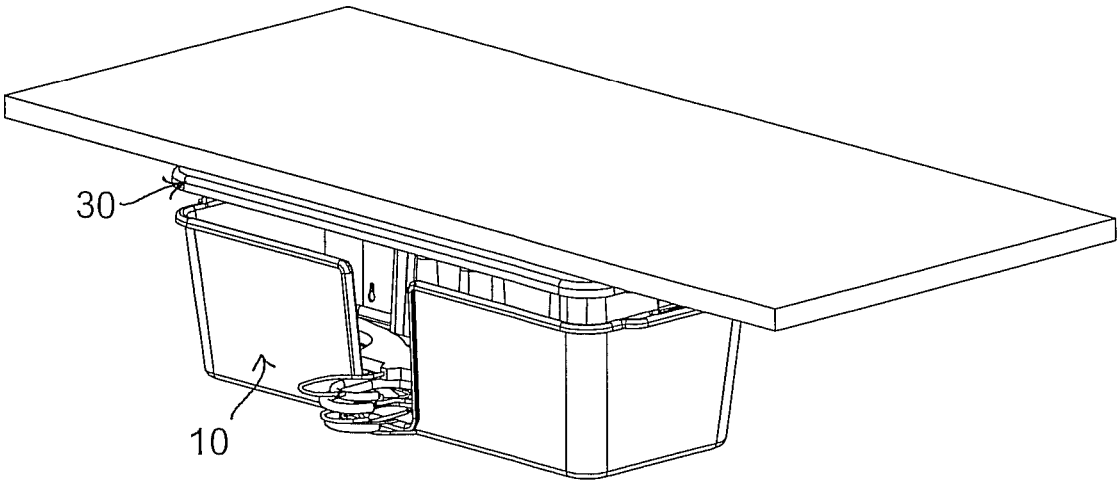
FIG. 14 is a perspective view of the embodiment shown in FIG. 11A, wherein the clothes hanger storage device is shown attached to the underside of a counter-top, and the lid is in the raised position.

In an especially preferred embodiment, the container 10 is fitted with a lid 30. The lid 30 is adapted to be secured to the top edge 20 of the container 10 (see FIGS. 10A and 10B). Preferably, the lid 30 is the same shape as the container 10 and the lid 30 is also substantially flat or planar, so that multiple containers could be stacked upon one another with their lids on, and so that the lid may be attached to the underside of a table or counter top (see FIG. 14). Further, the lid 30 may be adapted to include latches 40 for further securing the lid 30 to the container 10. In the preferred embodiment, the latches 40 are attached to the short ends 31 of the lid 30. The latches 40 comprise a plurality of spaced connection members that may be releasably connected to the container 10. Preferably, the connection members comprise a single protrusion 42 near the top of the latch 40 and a set of two protrusions 44, 46 near the bottom of the latch 40 (see FIGS. 10B and 11B).

Figure 10A:
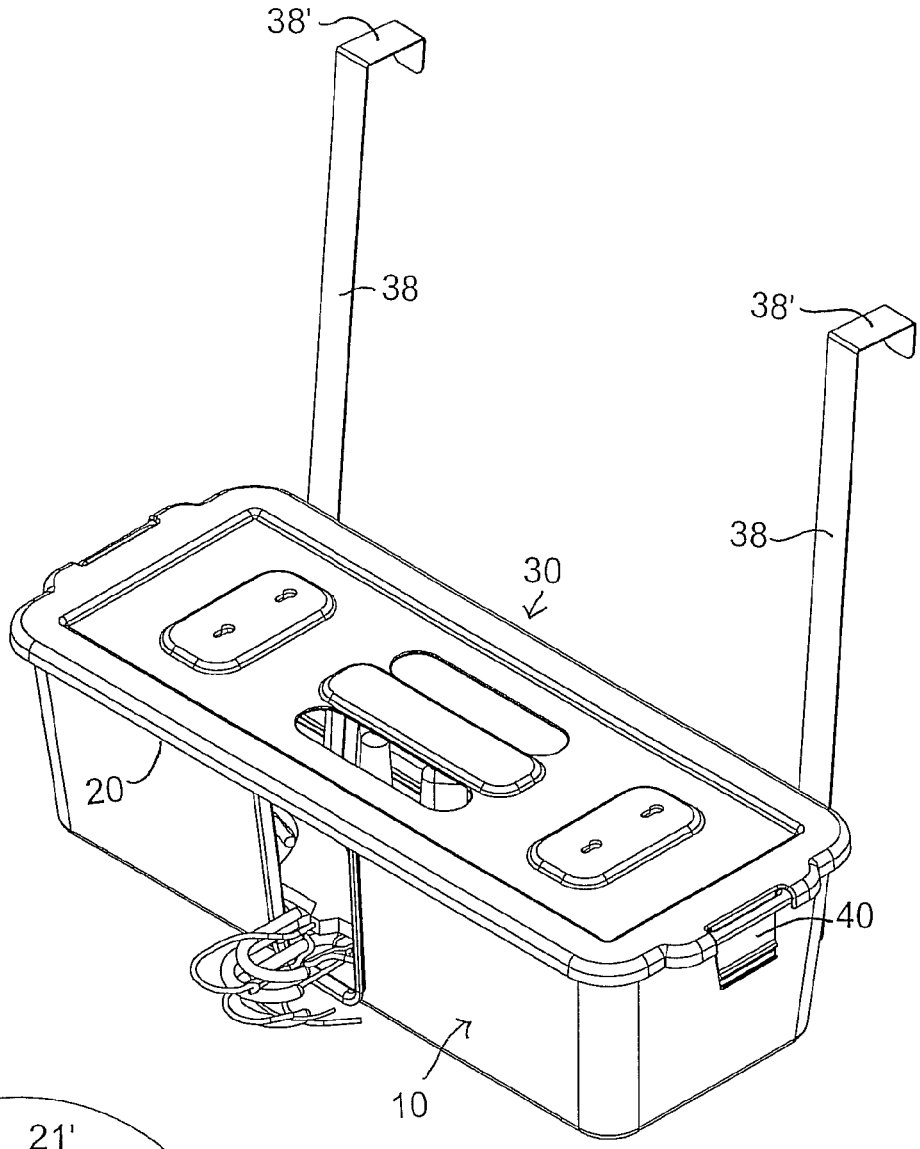
FIG. 10A is a perspective view of an alternative embodiment of the invented clothes hanger storage device, wherein the lid of FIGS. 8 and 9 is shown in combination with the container of FIGS. 4 and 7 and the lid is in a closed position.
Figure 10B:
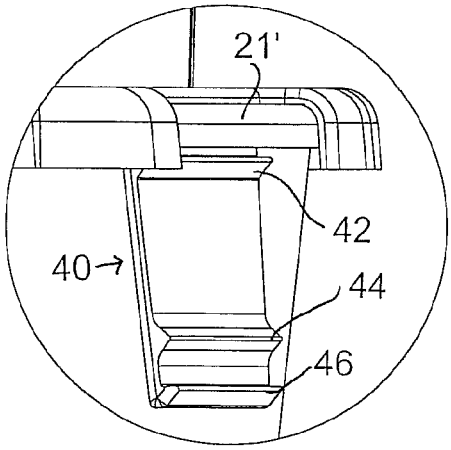
FIG. 10B is a detail of the latch of FIG. 10 in the closed position.
Figure 11A:
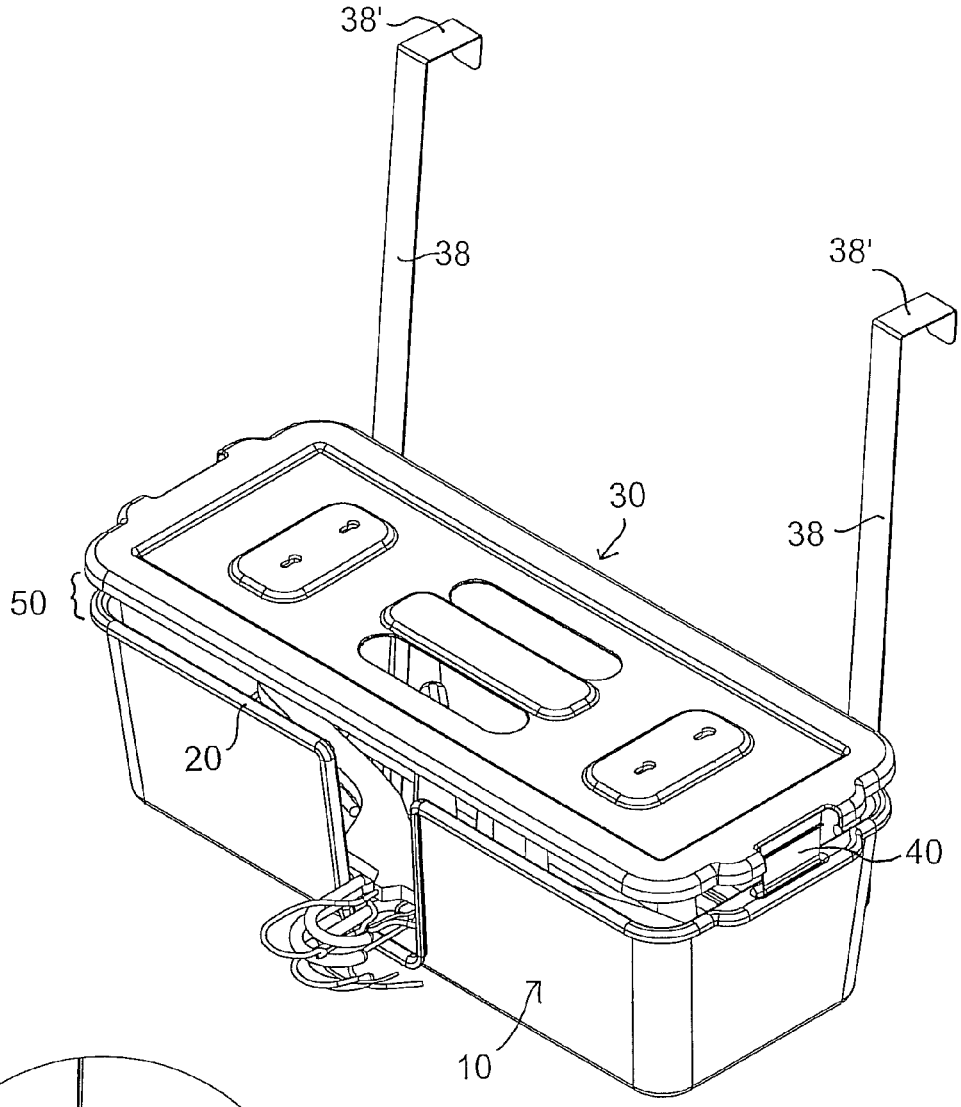
FIG. 11A is a perspective view of the embodiment shown in FIG. 10A, wherein the lid is shown in a raised position.
Figure 11B:
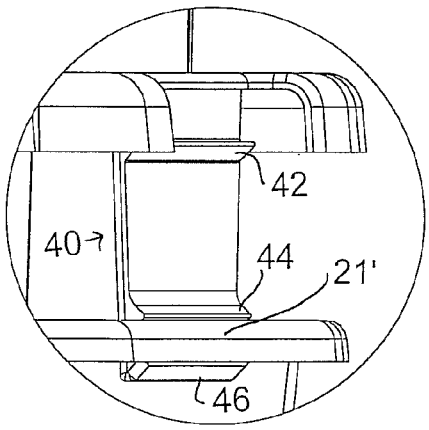
FIG. 11B is a detail of the latch of FIG. 11 in the raised position.

The latches 40 permit the lid 30 to moved from a closed position, as shown in FIG. 10A, to a raised or dispensing position, as shown in FIG. 11A. When the lid 30 is in the closed position (see FIGS. 10A and 10B), the latches 40 are slid all the way into the apertures 21 in the top edge 20 of the container 10, so that the lid 30 is fitted entirely around the top edge 20 of the container 10, and the single protrusion 42 abuts against the edge 21' of the aperture 21 preventing the lid 30 from coming off of the container 10. When the lid 30 is in the raised or dispensing position (see FIGS. 11A and 11B), the lid 30 is positioned above the container 10, so that it is generally parallel to, but slightly distanced from the container 10, and the lower set of protrusions 44, 46 are positioned around the edge 21' of the aperture 21. As shown in FIG. 11B, protrusion 44 is positioned above the edge 21', and protrusion 46 is positioned below the edge 21', so that the edge 21' is trapped between the lower two protrusions 44, 46. Thus, the protrusions 42, 44, 46 act as stops or grips, which retain the latches 40, and hence, the lid 30 in either of the two desired positions. The protrusions 42, 44, 46 may themselves snap onto or around the edge 21', or may simply abut against the edge 21', but preferably there is some resilience in either the protrusions 42, 44, 46 or the latch hinges, in order to retain the latches 40 in the selected position once the user has moved the latches 40 (as discussed below), and/or purposely snapped the protrusions around the edge 21'.

In order to move the lid 30 from the closed position to the raised or dispensing position, the user must press the latches 40 toward the end walls 18 of the container 10, and then raise the lid 30 until the protrusions 44, 46 snap around the edge 21' securing the lid 30 in the raised position. The latches 40 may be designed to create, in the raised position, a space 50 that is 2"-4" from the bottom of the lid 30 to the top edge 20 of the container 10. When the lid 30 is in the raised position, the user may remove one or more hangers by sliding the hangers off of the pillars 22, 23 and/or 24, 25, and out through the space 50 between the top edge 20 of the container 10 and the lid 30. Preferably, 1-3 hangers may be lifted up and forward out of the device through the space 50. The latches 40 are preferably made of a sturdy material, so as to support the lid 30 above the container 10. Additionally, other latch mechanisms may be used, such as a latch mechanism that wraps or snaps around the outside of the container wall instead of going through an aperture in the container, such as arm(s), rod(s), or other fasteners that can hold the lid in multiple positions relative to the container.

Figure 4:
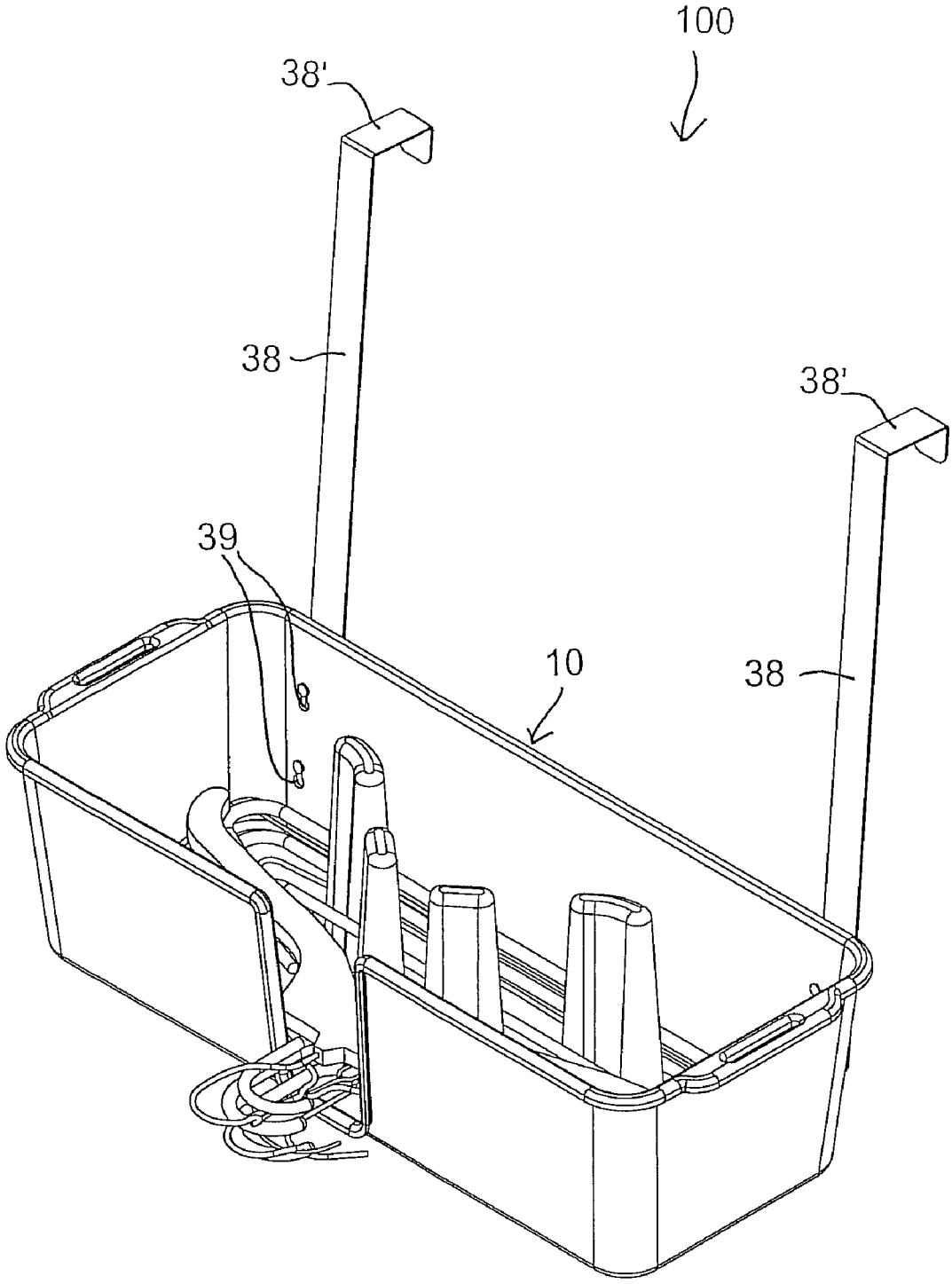
FIG. 4 is a perspective view of an alternative embodiment of the invented clothes hanger storage device, wherein the container is fitted with brackets for attaching the clothes hanger storage device to a door, and wherein hangers are shown positioned inside the container.
Figure 8:
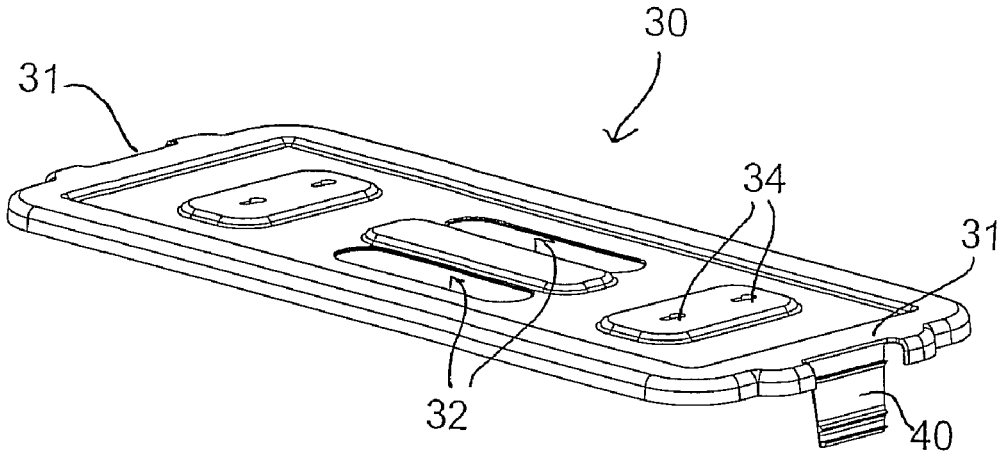
FIG. 8 is a side perspective view of one embodiment of a lid that may cooperate with the containers shown in FIGS. 1-7.
Figure 9:
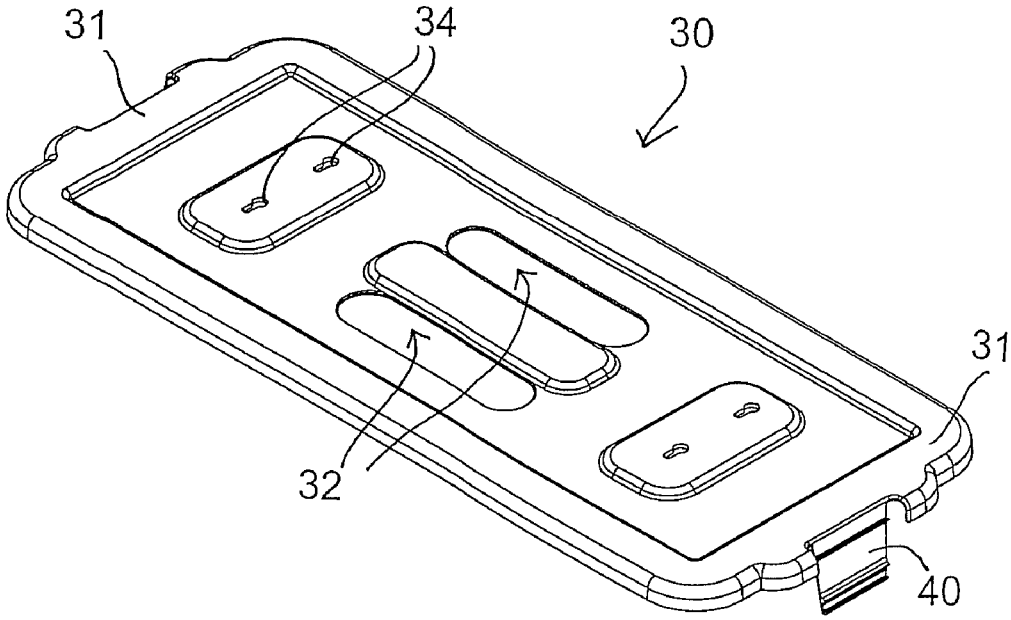
FIG. 9 is a top perspective view of the lid shown in FIG. 8.
Figure 13:
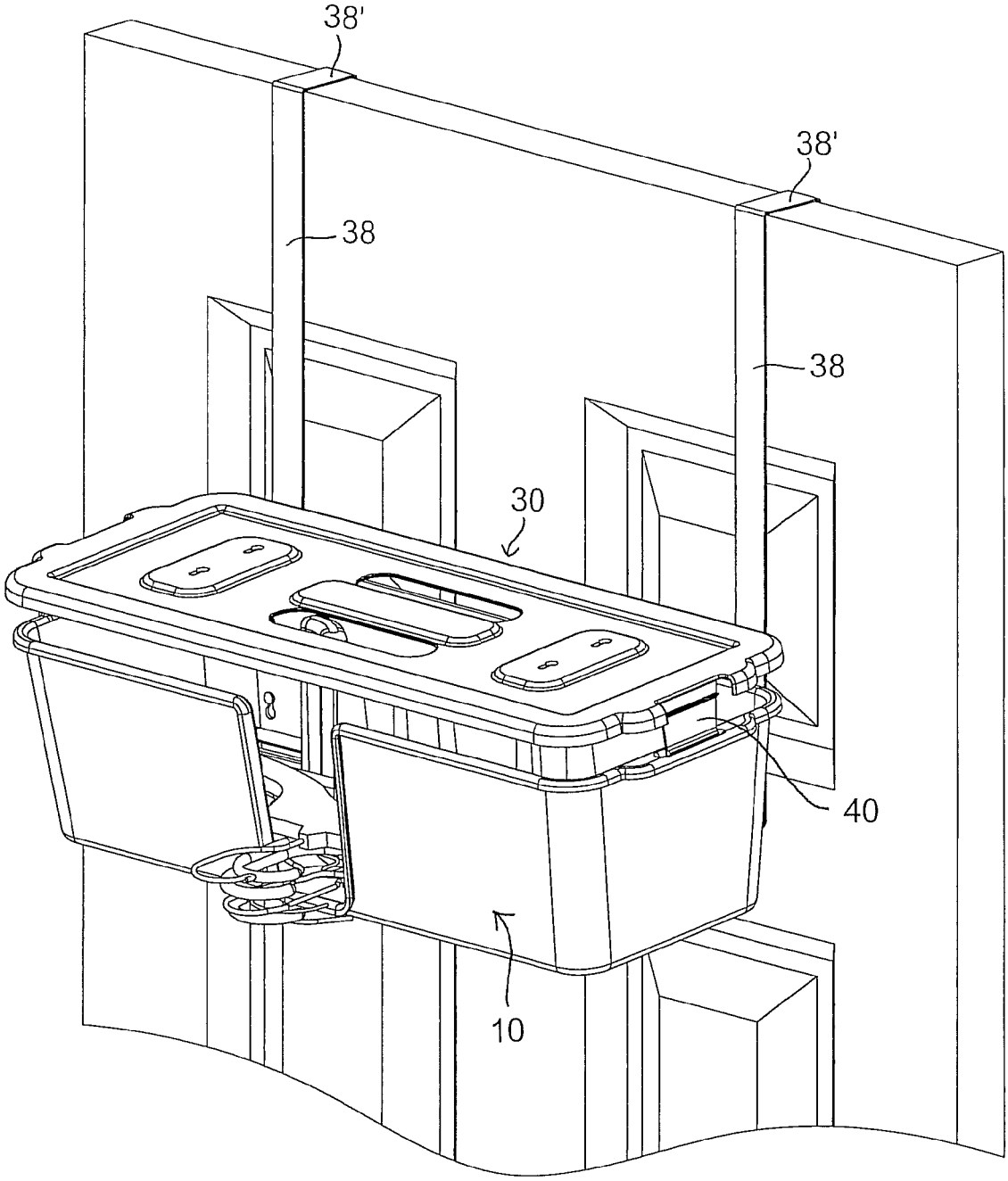
FIG. 13 is a perspective view of the embodiment shown in FIG. 11A, wherein the clothes hanger storage device is shown hung from a door, and the lid is in the raised position.

The lid 30 and/or container 10 may be adapted to include mechanisms for aiding in storing or carrying the clothes hanger storage device 100. For example, in order to attach the lid 30 to the underside of a table or counter top, holes 34 may be molded into the lid 30, or otherwise provided, in order to screw the lid 30 into a table or counter top. Other means of attaching the lid 30 or container 10 without the lid 30 to a table or counter top may be used, such as adhesive strips, chain links, or the lid 30 and/or container 10 may cooperate with glide rails that allow the clothes hanger storage device to be slid out from underneath the table or counter top. As shown in FIGS. 8 and 9, the lid 30 has apertures 32 that act as a handle for gripping the container and carrying it. The lid 30 may be adapted to have other handle structures, such as a handle that is raised above the lid; however, this would be less preferable because it would be difficult to stack the containers. Additionally, the lid 30 may be adapted to not include a handle and the user could carry the clothes hanger storage device 100 by gripping the sides of the container 10 and the lid 30. As shown in FIGS. 2 and 4, the container 10 may also be fitted with holes 39 in a side wall for attaching brackets 38. The brackets 38 preferably have a hooked end 38' allowing the container 10 to be hung from a door, cabinet door, or other structure comprising an edge (see FIG. 13). Alternatively, the container 10 may be attached to a door or cabinet by drilling through the holes 39 and securing the container with screws. Further, the clothes hanger storage device 100 may be stored in a closet or cabinet with no additional securement mechanism.

Although this invention has been described above with reference to particular means, materials and embodiments, it is to be understood that the invention is not limited to these disclosed particulars, but extends instead to all equivalents within the scope of the following claims.

We claim:

1. A clothes hanger storage and dispensing device comprising:

a container comprising a base and a side wall upending from the base to surround and define an interior space, wherein said side wall comprises a top edge defining a top opening into the container and wherein said side wall further comprises a slot in a front region of said side wall;

a plurality of pillars inside said interior space upending from said base;

the container interior space and plurality of pillars being adapted to receive a hanger comprising a generally triangular portion and a hook portion, wherein the generally triangular portion is received inside the interior space and around at least one of said pillars and wherein said hook portion extends out of the container through said slot; and, a lid that is removably connected to said container, wherein the lid is moveable between, and latchable in, a plurality of positions comprising a closed position wherein the lid is latched to the container to close said top opening, and a raised position wherein said lid is latched to the container in a position generally parallel to, and distanced away from, said top edge, to define a space between said top edge and the lid for dispensing said hanger from the container, so that the hanger is liftable by its hook portion upwards into said space and forward out of said space for removal from the container;

wherein said lid is secured in said closed position and said raised position by a plurality of latches, wherein at least two of said latches each comprise a plurality of spaced connection members that are releasably connectable to the container; and wherein one or more of said connection members connect to the container by means selected from the group consisting of: releaseably gripping said top edge and abutting said top edge.

2. A device as in claim 1, wherein said lid in the raised position, being spaced a distance from said top edge, defines a space between said top edge and said lid for dispensing said hanger from said container, said space being 2-4 inches from a bottom surface of the lid to said top edge, so that, after the hanger is lifted up to the lid, said hanger will slide forward out of the device through said space.

3. A device as in claim 1, wherein said lid comprises holes receiving screws for being attached to an underside of a table or counter top, wherein that the device is hangable from the table or counter top with the lid positioned in each of said closed position and said raised position.

4. A device as in claim 1, further comprising one or more brackets extending from said sidewall and having a hooked end for extending over a door.

5. A device as in claim 1, wherein said container is rectangular.

6. A clothes hanger storage and dispensing device comprising:

a container comprising a base and a side wall upending from the base to surround and define an interior space, wherein said side wall comprises a top edge defining a top opening into the container and wherein said side wall further comprises a slot in a front region of said side wall;

a plurality of pillars inside said interior space upending from said base;

the container interior space and plurality of pillars being adapted to receive a hanger comprising a generally triangular portion and a hook portion, wherein the generally triangular portion is received inside the interior space and around at least one of said pillars and wherein said hook portion extends out of the container through said slot; and, a lid that is removably connected to said container, wherein the lid is moveable between, and latchable in, a plurality of positions comprising a closed position wherein the lid is latched to the container to close said top opening, and a raised position wherein said lid is latched to the container in a position generally parallel to, and distanced away from, said top edge, to define a space between said top edge and the lid for dispensing said hanger from the container, so that the hanger is liftable by its hook portion upwards into said space and forward out of said space for removal from the container;

wherein said container comprises handles in said top edge that each have an aperture, and wherein said lid comprises a plurality of latches that cooperate with said apertures to latch said lid in the closed position and in the raised position.

7. A clothes hanger storage and dispensing device comprising:

a container comprising a floor and a side wall upending from the floor to surround and define an interior space, wherein said side wall comprises a top edge defining a top opening into the container and wherein said side wall further comprises a slot in a front region of said side wall;

a plurality of pillars inside said interior space arranged as a front set of pillars and a rear set of pillars;

the container interior space and plurality of pillars being adapted to receive a first hanger having a generally triangular main body and a hook, wherein said first hanger main body is located inside said container and extending around both of said front set of pillars and said rear set of pillars, and wherein said hook of the first hanger extends out of the device through said slot; and the container interior space and plurality of pillars also being adapted to receive a second hanger having a generally triangular main body and a hook, wherein said second hanger main body has a base side opposite of the second hanger hook, said base side having a length, wherein said second hanger main body is located inside said container and extending around only said front set of pillars so that said base side is received between said front set of pillars and said rear set of pillars, and wherein the hook of said second hanger extends out of the device through said slot;

wherein said front set and said rear set of pillars are distanced 0.5-1 inches apart for receiving and trapping said base side of the second hanger between said front set and said rear set of pillars; and the device further comprising a lid that is removably connected to said container in a plurality of positions comprising a first position wherein the lid is secured to contact said top edge of the container to close said top opening, and a second position wherein said lid is secured in a position distanced from said container and generally parallel to said top edge, to define a space between said top edge and the lid for dispensing said first or second hanger from the container, so that the hanger is liftable by its hook portion upwards into said space and forward out of said space for removal from the container;

wherein said lid is secured in said first position and said second position by a plurality of latches, wherein each latch comprises a plurality of protrusions spaced apart on the latch and releasably connectable to the container; and wherein said one or more of said protrusions connect to the container by means selected from the group consisting of: releaseably gripping said top edge, and abutting said top edge.

8. A device as in claim 7, wherein said front set of pillars is spaced from said rear set of pillars a distance no greater than the thickness of said elongated base of the second hanger.

9. A device as in claim 7, wherein said space is sized to be 2-4inches from a bottom surface of the lid to said top edge.

10. A device as in claim 7, wherein said lid comprises holes receiving screws for being attached to an underside of a table or counter top, wherein that the device is hangable from the table or counter top with the lid positioned in each of said first position and said second position.

11. A device as in claim 7, further comprising one or more brackets extending from said sidewall and having a hooked end for extending over a door.

12. A device as in claim 7, wherein said container is rectangular.

13. A clothes hanger storage and dispensing device comprising:

a container comprising a floor and a side wall upending from the floor to surround and define an interior space, wherein said side wall comprises a top edge defining a top opening into the container and wherein said side wall further comprises a slot in a front region of said side wall;

a plurality of pillars inside said interior space arranged as a front set of pillars and a rear set of pillars, the container interior space and plurality of pillars being adapted to receive a first hanger having a generally triangular main body and a hook, wherein said first hanger main body is located inside said container and extending around both of said front set of pillars and said rear set of pillars, and wherein said hook of the first hanger extends out of the device through said slot; and the container interior space and plurality of pillars also being adapted to receive a second hanger having a generally triangular main body and a hook, wherein said second hanger main body has a base side opposite of the second hanger hook, said base side having a length, wherein said second hanger main body is located inside said container and extending around only said front set of pillars so that said base side is received between said front set of pillars and said rear set of pillars, and wherein the hook of said second hanger extends out of the device through said slot;

wherein said front set and said rear set of pillars are distanced 0.5-1 inches apart for receiving and trapping said base side of the second hanger between said front set and said rear set of pillars; and the device further comprising a lid that is removably connected to said container in a plurality of positions comprising a first position wherein the lid is secured to contact said top edge of the container to close said top opening, and a second position wherein said lid is secured in a position distanced from said container and generally parallel to said top edge, to define a space between said top edge and the lid for dispensing said first or second hanger from the container, so that the hanger is liftable by its hook portion upwards into said space and forward out of said space for removal from the container;

wherein said lid is secured in said first position and said second position by a plurality of latches, wherein each latch comprises a plurality of protrusions spaced apart on the latch and releasably connectable to the container; and wherein said container comprises handles in said top edge that each have an aperture, and wherein said protrusions cooperate with said apertures to latch said lid in the first position and in the second position.

* * * * *